United States Patent [19]

Becker

[11] Patent Number: 4,793,889

[45] Date of Patent: Dec. 27, 1988

[54] HAND LABELING DEVICE

[75] Inventor: Werner Becker, Hirschhorn, Fed. Rep. of Germany

[73] Assignee: Esselte Meto International Produktions GmbH, Fed. Rep. of Germany

[21] Appl. No.: 162,255

[22] Filed: Feb. 29, 1988

[30] Foreign Application Priority Data

Feb. 27, 1987 [DE] Fed. Rep. of Germany ..... 3706439

[51] Int. Cl.[4] ..... B65C 11/02; B41F 1/46

[52] U.S. Cl. ..... 156/384; 101/288; 101/295; 101/324; 101/348; 156/579; 156/DIG. 49

[58] Field of Search ..... 156/384, 577, 579, DIG. 48, 156/DIG. 49; 101/288, 295, 305, 320, 324, 326, 348

[56] References Cited

U.S. PATENT DOCUMENTS

| | | | |
|---|---|---|---|
| 4,057,452 | 11/1977 | Sato | 156/384 |
| 4,113,544 | 9/1978 | Sato | 156/384 |
| 4,273,046 | 6/1981 | Sato | 101/348 |
| 4,313,377 | 2/1982 | Sato | 101/295 |
| 4,356,767 | 11/1982 | Sato | 101/295 |
| 4,406,727 | 9/1983 | Fujita | 156/384 |
| 4,724,034 | 2/1988 | Becker | 156/384 |

*Primary Examiner*—Michael Wityshyn
*Attorney, Agent, or Firm*—Gerald J. Ferguson, Jr.

[57] ABSTRACT

A hand labeling device is described with the aid of which self-adhering labels in the course of an operating cycle can be imprinted, dispensed and attached to articles. In a device housing a printing mechanism (34) is arranged for producing an imprint on a self-adhering label disposed in a printing position. A transport means (22) brings the self-adhering labels consecutively into the printing position and into the position for application to the articles. The printing types of the printing mechanism (34) are inked with the aid of an inking device before each printing operation, said device including an inking roll (46) which is adapted to roll on the print types and which is rotatably mounted in an inking roll holder (48) which during the rolling of the inking roll on the print types is guided in a guideway (54) in the housing by means of guide pins (52, 53) extending parallel to the inking roll. The guideway (54) comprises an exit opening (64) for the guide pins (52, 53) on the inking roll holder (48) and on the device housing (10) a flap (56) is provided which is pivotal between a closed and an open position and on which at least one extension (60) is disposed which in the closed position of the flap (56) closes the exit opening (64) of the guideway (54).

3 Claims, 6 Drawing Sheets

HAND LABELING DEVICE

Figure 1:
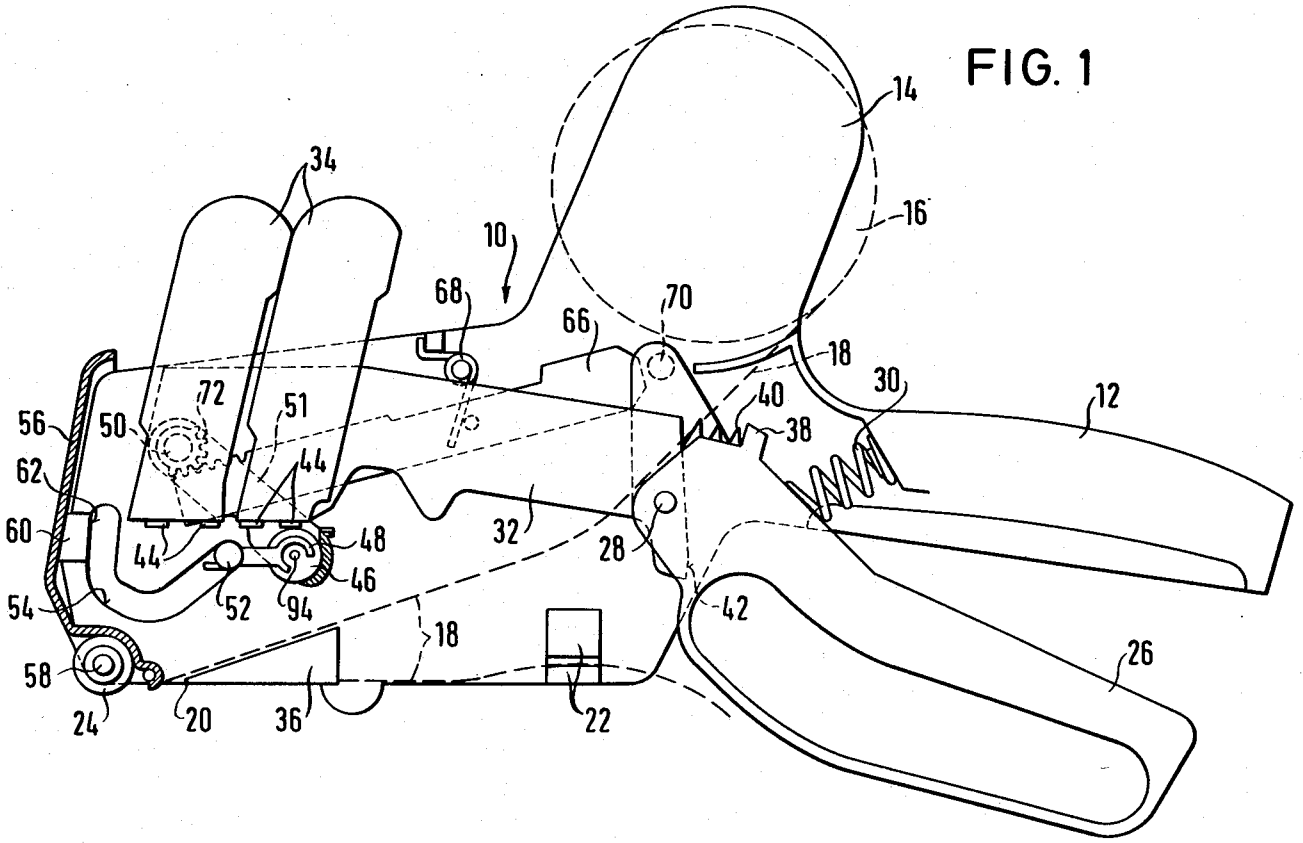

The invention relates to a hand labeling device for imprinting, dispensing and applying self-adhering labels to articles in the course of an operating cycle, comprising a printing mechanism accommodated in a device housing and having print types for generating an imprint on a selfadhering label disposed in a printing position, a transport means which brings the self-adhering labels consecutively into the printing position and into the position for application to the articles, and an inking means for inking the print types of the printing mechanism before each printing operation and including an inking roll which is adapted to be rolled on the print types of the printing mechanism and which is rotatably mounted in an inking roll holder which during the rolling of the inking roll on the print types is guided in a guideway in the housing by means of guide pins extending parallel to the inking roll.

Such a hand labeling device is known from German specification as laid open to inspection No. 2,618,502. In devices of this type to generate uniform imprints on the self-adhering labels it is absolutely essential that the print types are uniformly inked by the inking roll before they encounter the label. To achieve this the inking rlll holder is guided in the known device in a guideway along which the guide pins on the inking roll holder move during the inking operation. In spite of the reliable guiding of the inking roll holder in the device housing it must however be possible to easily replace the inking roll when it is used up and in particular it must be ensured that the replacement can be carried out without the operator soiling his fingers with printing ink which is difficult to remove. To achieve this in the known device in addition to the inking roll holder a support clip clampable thereto is provided on which the inking roll is then secured. The support clip has in the manner of a clothes peg two legs which are connected to each other in such a manner that by pressing together on one side of the connection point they move apart on the other side of the connection point. The ends of the legs lying on one side of the connection point carry the inking roll whilst the other ends in a predetermined phase of the actuating cycle of the device can be gripped at the device front face by the operator for removing the support clip from the device. Since the ends of the support clip to be gripped always project to a relatively great extent at the front side of the device the front side must be correspondingly arched forwardly and this unnecessarily increases the overall length of the device and therefore disadvantageously affects the weight distribution in the hand of the operator and the appearance.

The invention is based on the problem of further developing a hand labeling device of the type outlined at the beginning in such a manner that a reliable and stable guiding of the inking roll holder in the device is achieved without thereby making the inking roll replacement difficult or disadvantageously influencing the dimensions of the device and its appearance.

According to the invention this problem is solved in that the guideway comprises an exit opening for the guide pins on the inking roll holder and that the device housing is provided with a flap which is pivotal between a closed and an open position and on which at least one extension is disposed which in the closed position of the flap closes the exit opening of the guideway.

In the device according to the invention the guideway closed in the operating state of the device ensures reliable and stable guiding of the inking roll holder. For changing the inking roll it is merely necessary to open the flap on the device, thereby simultaneously also freeing the exit opening of the guideway so that the guide pins can emerge from the guideway. The inking roll holder may then easily be removed by the operator from the device and replaced by an inking roll holder provided with a new inking roll.

An advantageous further development of the invention resides in that the guide pins are disposed on the inking roll holder on side faces of a web which comprises two arms which hold the inking roll and which lie substantially in a plane with the guide pins, the inking roll holder and the web. The web serves to stiffen the inking roll holder and makes it possible for the operator to grip the inking roll holder in such a manner that direct contact of the inking roll is avoided with certainty.

A further development resides in that the guideway in the device housing has a path such that the guide pins and the web connecting them emerge from the guideway when the flap is in the open position and the guide pins in the course of their movement in the guideway come into the region of the exit opening. The selected course of the guideway ensures that the guide pins and the web when the flap is open automatically come out of the guideway. The operator thus need not first put his fingers into the device and pivot out the guide pins and the web for gripping and replacing the inking roll holder.

Figure 2:
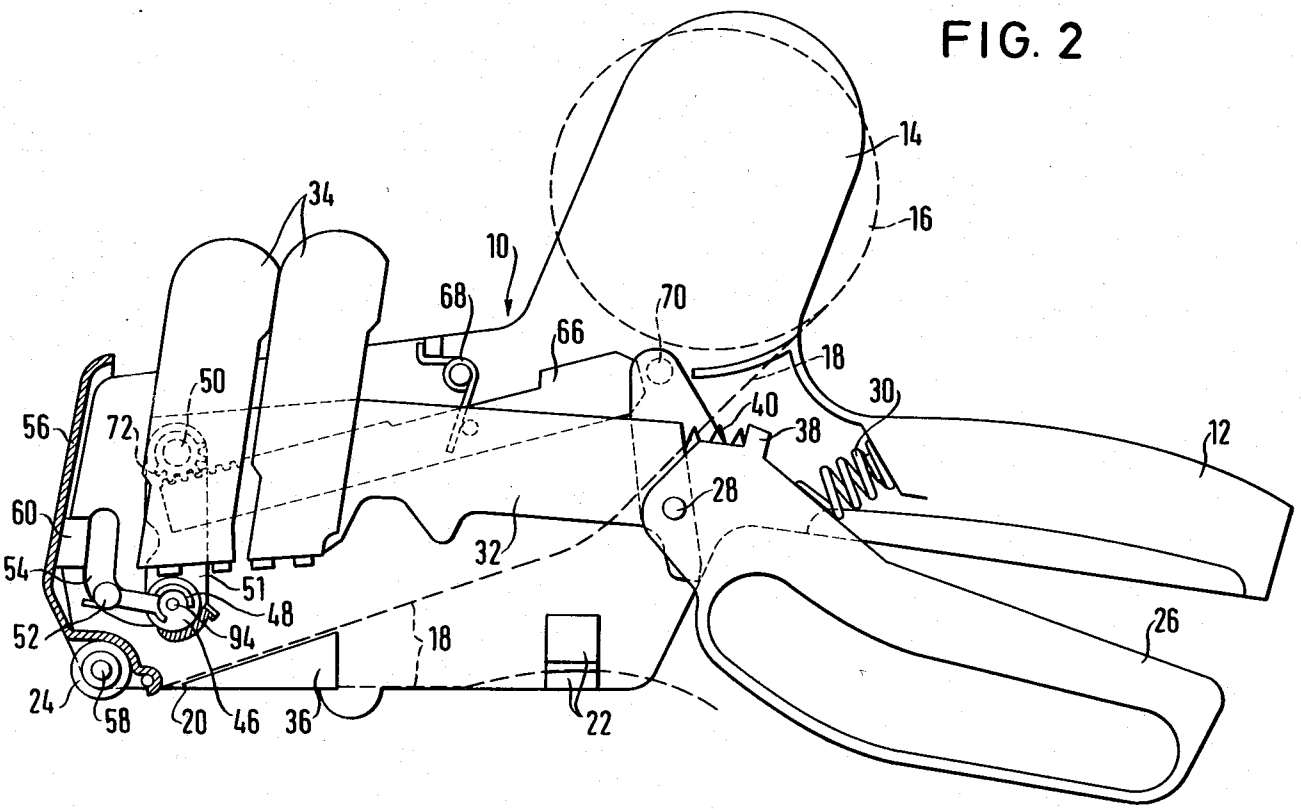
Figure 3:
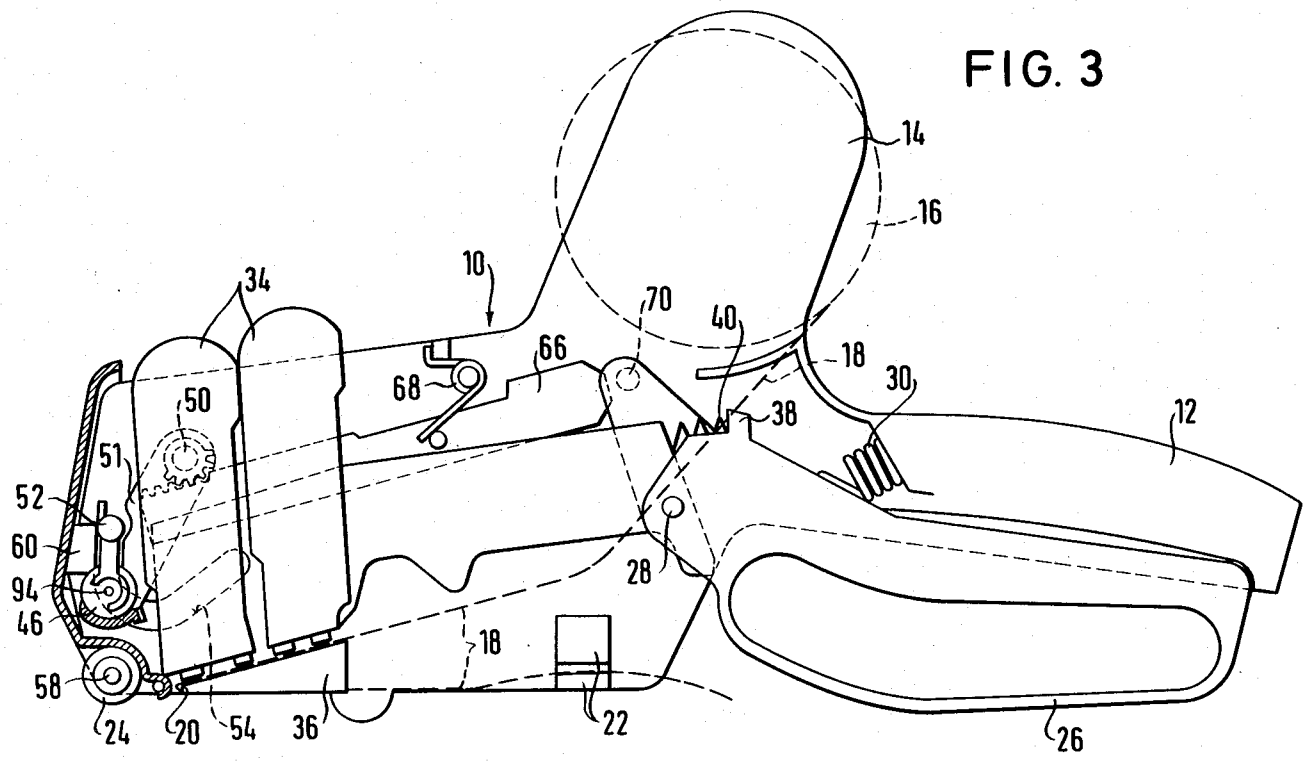
Figure 4:
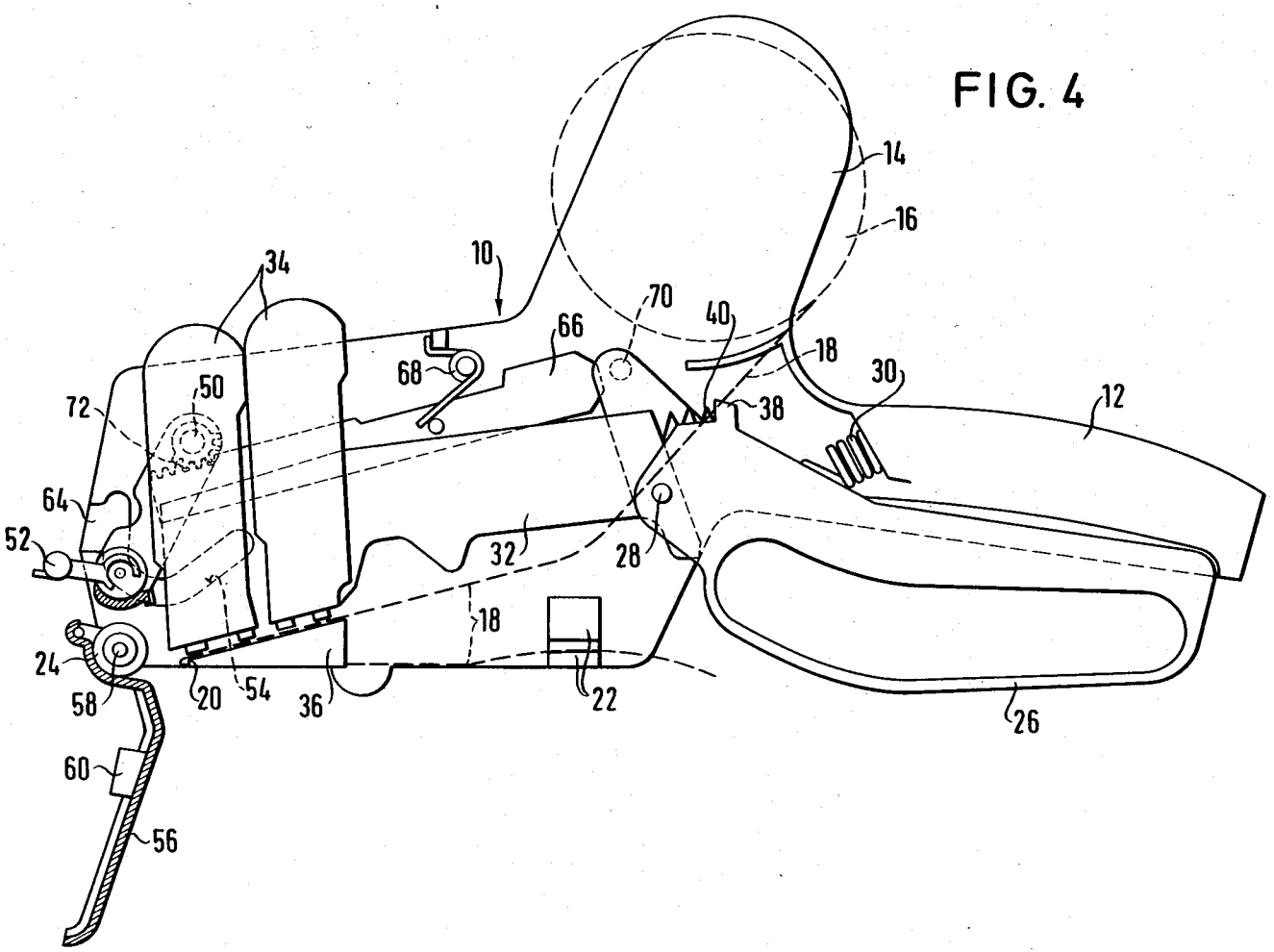
Figure 6:
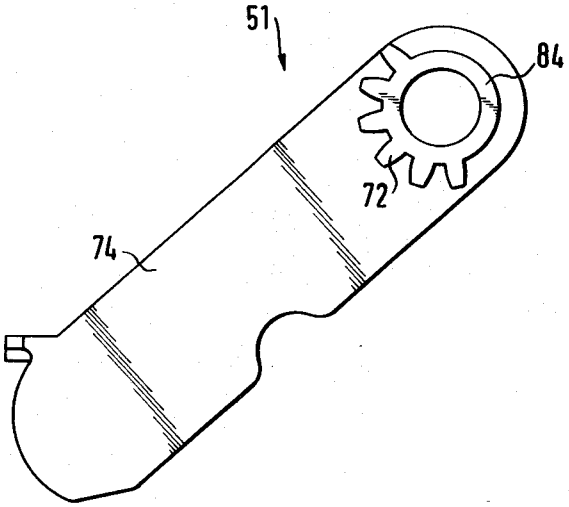
Figure 5:
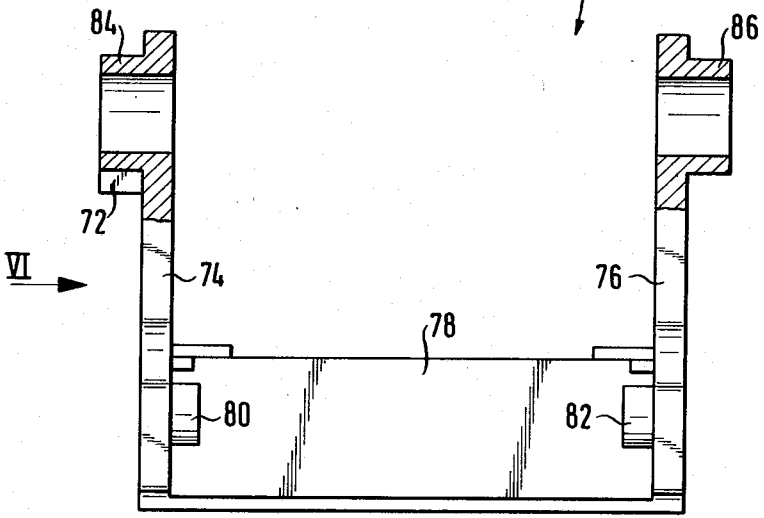
Figure 8:
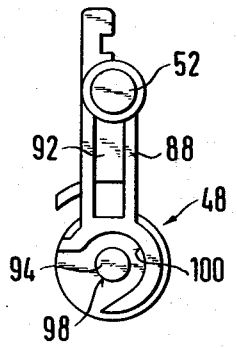
Figure 7:
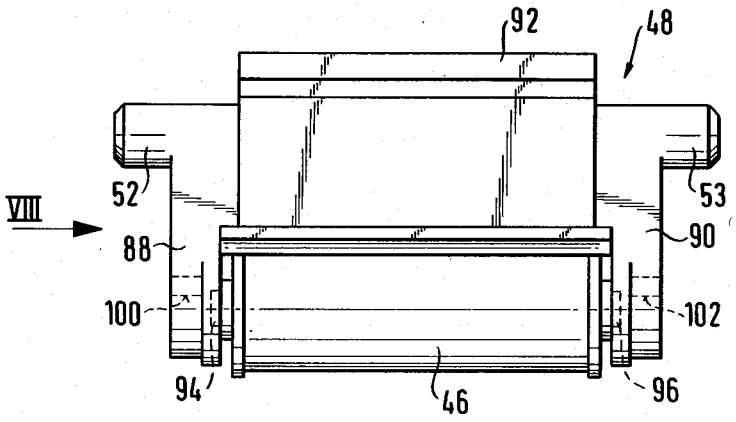

The invention will be explained by way of example with the aid of the drawings, wherein:

FIG. 1 is a schematic illustration of a hand labeling device according to the invention, the parts moving in the course of an operating cycle being in the rest position, FIG. 2 is a view of the device according to FIG. 1 after the start of an operating cycle when the printing mechanism has begun to move in the direction towards a label to be imprinted, FIG. 3 is a further view of the device of FIG. 1 at the instant when the printing mechanism meets a label to be imprinted, FIG. 4 is a similar view to FIG. 3 but the front flap of the device is open, FIG. 5 is an enlarged view of a pivot stirrup member carrying the inking roll holder in the device, FIG. 6 is a view of the pivot stirrup member from the side marked with an arrow in FIG. 5, FIG. 7 is a view of the inking roll holder with inserted inking roll and FIG. 8 is a side view of the inking roll holder from the side marked with an arrow in FIG. 7.

The hand labeling device illustrated in FIG. 1 serves to imprint an dispense self-adhering labels and attach them to articles. The device comprises a housing 10 on which a grip 12 is disposed. At the housing upper side there is a holder 14 for receiving a supply roll 16 of a carrier ribbon 18 on which self-adhesive labels stick. The carrier ribbon extends in the device from the supply roll 16 firstly downwardly and then in the direction to the front side of the device to a dispensing edge 20 at which the carrier ribbon 18 is deflected at an acute angle and is guided by a transport means 22 to the housing rear end. Rotatably mounted in the housing in front of the dispensing edge 20 is an application roller with which a label detached from the carrier ribbon 18 and disposed beneath the application roller in the dispensing position can be stuck onto an article.

Beneath the grip 12 an operating lever 26 is arranged which is pivotal about a pin or shaft 28. Between the grip 12 and the operating lever 26 there is a spring 30 which always tends to press the operating lever into the rest position illustrated in FIG. 1. Also located in the housing 10 is a printing mechanism support 32 which is also pivotally mounted about the shaft 28. Said printing mechanism support 32 carries a printing mechanism 34 with the aid of which a self-adhering label disposed on the printing table 36 can be imprinted. Between an arm 38 of the operating lever 26 and the printing mechanism support 32 a spring 40 is disposed which serves to transmit a movement of the operating lever 26 directed against the grip 12 to the printing mechanism support 32. In the rest position illustrated in FIG. 1 the printing mechamism support 32 is held in the raised position by an engagement face 42 on the operating lever 26.

The printing mechanism 34 comprises at its face facing the printing table 36 print types 44 which can be inked before each printing operation by means of an inking device. The most important part of the inking device is an inking roll 46 which is rotatably mounted in an inking roll holder 48. Details of the inking roll holder 48 will be explained hereinafter with reference to FIGS. 7 and 8. The inking roll holder 48 is mounted in turn in a stirrup member 51 which is pivotal about a shaft or pin 50 and the structure of which will be explained in connection with FIGS. 5 and 6.

Mounted on the inking roll holder 48 are two guide pins 52 and 53 which are guided in a guide track or path 54. The guideway apparent in FIG. 1 is in the inner face of the rear side wall of the housing 10, seen from the observer. A similar guideway 54 is disposed in the front side wall of the housing 10, not illustrated in FIG. 1. Accordingly, the inking roll holder 48 also has two guide studs or pins 52 and 53, each of which engages into one of the two guideways 54.

At the front side of the housing 10 there is a front flap 56 which can be pivoted about a shaft 58 forwardly into the open position shown in FIG. 4. The shaft 58 is at the same time also the shaft on which the application roller 24 is mounted. The front flap 56 is provided with an extension 60 which is directed toward the housing interior and the end face 62 of which forms part of the guide track 54. As apparent from FIGS. 1 and 4 the guideway 54 has towards the device front side an exit opening 64 which in the closed position of the front flap 56 is closed by the lug or extension 60. The purpose of this exit opening 64 will become apparent from the description of the mode of operation of the device described.

Between the operating lever 26 and the pivot stirrup member 51 a thrust rod 66 is disposed which with the aid of a spring 68 is biased in the direction towards a pin 70 on the operating lever 26. The rest position to which the thrust rod 66 is biased by spring 68 is shown in FIG. 1. The thrust rod 66 is formed at the end lying in the region of the stirrup member 51 as rack. The stirrup member 51 comprises a pinion 72 which is in engagement with the teeth at the rack end of the thrust rod 66. It can be seen from the illustration of FIG. 1 that the stirrup member 51 is pivoted out of the rest position shown clockwise about the shaft 50 when the thrust rod 66 moves to the left.

In FIGS. 5 and 6 the stirrup member 51 carrying the inking roll holder 48 is shown in more detail. The stirrup member 51 comprises two arms 74, 76 which are connected together by a web 78. At the inner side the arms 74, 76 comprise in the region of the web 78 two pins 80, 82 which serve to mount the inking roll holder 48. Bearing bushes 84, 86 are disposed on the arms 74, 76 at the upper ends in FIG. 5 and with the aid of said bushes the stirrup member 51 can be rotatably mounted on pins which are disposed in the inner faces of the housing side walls. The teeth forming the pinion 72 are formed on a portion of the outer peripheral face of the bearing bush 84.

The guide pins 52, 53 are arranged according to FIG. 7 on the inking roll holder 48 in such a manner that they project laterally at arms 88 and 90, respectively. The arms 88, 90 are connected by means of a web 92. The inking roll 4 is secured between the arms 88, 90 of the inking roll holder 48; said roll comprises two journals 94, 96 which are shown in dashed line in FIG. 7 and each of which engages into a corresponding hole 98 in the associated arms 88, 90 of the inking roll holder 48.

Disposed on the outer face of the arms 88, 90 in the region of their lower ends in FIG. 7 are recesses 100 and 102 which are formed so that they can be placed over the pins 80, 82 on the stirrup member 51.

An operating cycle of the hand labeling device having the construction described above proceeds as follows:

When the operating lever 26 is pulled out of the rest position illustrated in FIG. 1 against the action of the spring 30 in the direction towards the grip 12 the movement of the operating lever 26 taking place anticlockwise about the shaft 28 is transmitted by means of the arm 38 and the spring 40 to the printing mechanism support 32. The printing mechanism support 32 therefore also rotates anticlockwise about the shaft 28 and thereby lowers the printing mechanism 34 in the direction towards the printing table 36. Via a lever connection, not illustrated, the transport means 22 is shifted to the left along the carrier ribbon 18 in the view of FIG. 1 due to the movement of the printing mechanism support 32.

The detailed structure of the transport means 22 is of no significance here; it must merely effect that in the course of each operating cycle of the device the carrier ribbon is pulled exactly one transport step corresponding to a label width round the dispensing edge 20 so that in each operating cycle a self-adhering label moves on the printing table 36 into a printing position. A transport means which can be used for this purpose is described for example in No. DE-PS 3,200,977.

Due to the lowering movement of the printing mechanism 34 connected to the printing mechanism support 32 the printing mechanism 34 exerts on the stirrup member 51 a torque which pivots the stirrup member 51 clockwise. In the course of this pivot movement of the stirrup member 51 the inking roll 46 rolls on the print types 44 so that the latter are inked. At the same time the guide pins 52 and 53 move in the guideway 54 in the direction towards the device front side. As soon as the stirrup member 51 has reached a position in which the movement direction of the printing mechanism 34 extends exactly tangentially to the connecting line between the axis 50 of the stirrup member 51 and the axis of the inking roll 46 the printing mechanism 34 can no longer exert any torque on the stirrup member 51 so that a blocked state would be reached if the thrust rod 66 due to the engagement with the pinion 72 did not ensure further pivoting of the stirrup member 51. The pin 70 disposed at the upper end of the operating lever 26 ensures by engaging the thrust rod 66 that the latter is displaced in the direction towards the front side of the device so that accordingly the stirrup member 51 is also further moved in the clockwise direction. The position in which the thrust rod 66 starts to move the stirrup member 51 further is illustrated in FIG. 2.

Finally, the stirrup member with the inking roll holder disposed thereon is pivoted to such an extent that the printing mechanism 34 can move unrestricted downwardly in the direction towards the label disposed on the printing table 36. FIG. 3 shows the instant of the operating cycle at which the print types encounter the label disposed on the printing table 36 and generate the desired imprint. The guide pins 52, 53 are thereby at the end of the guideway 54.

At this instant in accordance with FIG. 3 the transport means 22 assumes its furthest left position. As soon as the operating lever 26 is released the transport means 22 moves back to the right again into its starting position illustrated in FIG. 1 but during this return movement it is fixedly connected to the carrier ribbon 18 so that it pulls the latter about the dispensing edge 20. During this movement of the carrier ribbon 18 the self-adhering label just imprinted detaches itself from the carrier ribbon and passes into a position between the application roller 24 in which it can be applied to an article.

When the operating lever 26 moves back again into its rest position illustrated in FIG. 1 the printing mechanism 34 lifts off the printing table 36 again and the spring 68 via its engagement with the thrust rod 66 and the action of the latter on the pinion 72 ensures that the stirrup member 51 also returns the inking roll holder to the starting position of FIG. 1.

In FIG. 4 the device described is shown with the front flap open. The front flap 56 must be opened or pivoted up when the inking roll 46 is to be replaced. To prepare for this replacement operation the front flap 56 is brought into the position illustrated in FIG. 4. Thereafter the operating lever 26 is pulled against the grip 12 until the printing mechanism 34 strikes the printing table 36. Since when the front flap 56 is open the exit opening 64 of the guideway 54 is open the guide pins 52, 53 in the course of their displacement can move through the exit opening 64 out of the guideway 54 into the position shown in FIG. 4. In the example of embodiment illustrated the guide pins 52, 53 automatically move out of the guideway 54 due to centrifugal forces when the operating lever 26 is pulled when the front flap 56 is open and the inking roll holder 48 is moved together with the inking roll 46 with relatively high speed. In this position the operator can grip the web 92 of the inking roll holder 48 and lift the inking roll holder 48 with the inking roll 46 mounted rotatably thereon out of the stirrup member 51. Preferably, the inking roll holder 48 and the inking roll 46 form a complete replacement unit so that it is not necessary to insert a new inking roll into the inking roll holder; instead, a new constructional unit consisting of an inking roll holder and an inking roll is simply inserted into the stirrup member 51. After the insertion the inking roll holder 48 is pivoted so that it assumes the position shown in FIG. 3 in which the guide pins 52, 53 lie in the guideway 54, whereupon the operating lever 26 is again released and as a result the inking roll holder 48 moves back with the inking roll 46 into the position of FIG. 1. Thereafter the front flap 56 is closed so that the extension 60 again closes the exit opening 64.

As a result the guideway 54 is also again closed so that the inking roll holder 48 is again guided via the guide pins 52, 53 and secured reliably in the device.

As already mentioned above in the inner face of each side wall of the housing 10 a guideway 54 is disposed so that accordingly two exit openings 64 are also present. The front flap 56 is thus also equipped with two lugs or extensions 60, each of which closes one of the exit openings 64.

In the further development of the hand labeling device described it is ensured that in spite of a reliable mounting and guiding of the inking roll holder and the inking roll in the device and obtaining satisfactory inking of the print types on the printing mechanism it is nevertheless very simple to remove a used inking roll and insert a new inking roll and this involves no danger of the operator soiling his fingers with the difficultly removable printing ink.

I claim:

1. Hand labeling device for imprinting, dispensing and applying self-adhering labels to articles in the course of an operating cycle, comprising a printing mechanism accommodated in a device housing and having print types for generating an imprint on a self-adhering label disposed in a printing position, a transport means which brings the self-adhering labels consecutively into the printing position and into the position for application to the articles, and an inking means for inking the print types of the printing mechanism before each printing operation and including an inking roll which inking roll is adapted to be rolled on the print types of the printing mechanism and which inking roll is rotatably mounted in an inking roll holder which inking roll holder during the rolling of the inking roll on the print types is guided in a guideway in the housing by means of guide pins extending parallel to the inking roll, characterized in that the guideway (54) comprises an exit opening (64) for the guide pins (52, 53) on the inking roll holder (48) and that the device housing (10) is provided with a flap (56) which flap is pivotal between a closed and an open position and on which flap at least one extension (60) is disposd which extension in the closed position of the flap (56) closes the exit opening (64) of the guideway (54).

2. Hand labeling device according to claim 1, characterized in that the guide pins (52, 53) are disposed on the inking roll holder (48) on side faces of a web (92) which inking roll holder comprises two arms (88, 90) which hold the inking roll (46) and which arms lie substantially in a plane with the guide pins (52, 53), the inking roll holder (46) and the web (92).

3. Hand labeling device according to claim 2, characterized in that the guideway (54) in the device housing (10) has a path such that the guide pins (52, 53) and the web (92) connecting the guide pins emerge from the guideway (54) when the flap (56) is in the open position and the guide pins (52, 53) in the course of their movement in the guideway (54) come into the region of the exit opening (64).

* * * * *